US007424953B2

(12) United States Patent
McCarty et al.

(10) Patent No.: US 7,424,953 B2
(45) Date of Patent: Sep. 16, 2008

(54) INCLUSIVE SOCKET ORGANIZER

(76) Inventors: Frank R. McCarty, 7619 E. Wabash Ave., Terre Haute, IN (US) 47803; Peter Van Horn, 823 Ohio, Terre Haute, IN (US) 47807

( * ) Notice: Subject to any disclaimer, the term of this patent is extended or adjusted under 35 U.S.C. 154(b) by 309 days.

(21) Appl. No.: 11/162,975

(22) Filed: Sep. 29, 2005

(65) Prior Publication Data

US 2006/0065564 A1 Mar. 30, 2006

Related U.S. Application Data

(60) Provisional application No. 60/614,223, filed on Sep. 29, 2004.

(51) Int. Cl.
*B65D 85/28* (2006.01)

(52) U.S. Cl. ..... 206/378; 206/372; 211/70.6

(58) Field of Classification Search ..... 206/349, 206/372, 373, 376, 377, 378; 211/70.6
See application file for complete search history.

(56) References Cited

U.S. PATENT DOCUMENTS

| | | | | | |
|---|---|---|---|---|---|
| 4,353,465 | A | | 10/1982 | Rado | 206/378 |
| 4,421,230 | A | * | 12/1983 | Stanton | 206/378 |
| 4,621,738 | A | * | 11/1986 | DeLucchi | 211/70.6 |
| 4,711,353 | A | * | 12/1987 | Rozmestor | 206/378 |
| 5,154,544 | A | | 10/1992 | Arendt | 206/375 |
| 5,344,012 | A | * | 9/1994 | Matthews | 206/372 |
| 5,368,164 | A | * | 11/1994 | Bennett et al. | 206/373 |
| 5,511,673 | A | * | 4/1996 | Folk | 211/70.6 |
| 5,573,116 | A | * | 11/1996 | Zink | 206/378 |
| 5,813,531 | A | * | 9/1998 | Kao | 206/373 |
| 6,109,437 | A | * | 8/2000 | Chao | 206/378 |
| 6,375,007 | B1 | * | 4/2002 | Huang | 206/373 |
| 6,390,298 | B1 | * | 5/2002 | Garro | 206/378 |
| 6,571,669 | B2 | | 6/2003 | Benatz et al. | 81/177.4 |
| 6,695,142 | B2 | * | 2/2004 | Chen et al. | 206/378 |
| 6,808,067 | B2 | | 10/2004 | Benatz et al. | 206/350 |
| 6,808,077 | B2 | | 10/2004 | McConnell | 211/70.6 |
| 2003/0106821 | A1 | * | 6/2003 | Bar-Erez | 206/373 |
| 2003/0205493 | A1 | * | 11/2003 | Chen et al. | 206/378 |
| 2004/0084342 | A1 | * | 5/2004 | Chang | 206/378 |

* cited by examiner

*Primary Examiner*—David T Fidei
(74) *Attorney, Agent, or Firm*—Lafkas Patent LLC; David M. Lafkas

(57) ABSTRACT

The present invention includes a transportable container for organizing various hand tool attachments. The transportable container has a handle, raised periphery edges, cavities for individually storing and retaining hand tool attachments, and one or more labels. The hand tool attachments are arranged in an order based on incremental shape, size, drive size, or a combination thereof. The one or more labels identifying the shape, size, drive size, or a combination thereof of an individualized hand tool attachment position within the container.

15 Claims, 7 Drawing Sheets

INCLUSIVE SOCKET ORGANIZER

CROSS-REFERENCE TO RELATED APPLICATION

This application for a patent claims priority to U.S. Provisional Patent Application No. 60/614,223 as filed Sep. 29, 2004.

BACKGROUND

The present invention relates generally to storage and organization of tools and/or tool accessories. More particularly, the present invention relates to a transportable container having visible labels and cavities for systematically storing and organizing individual sockets.

Socket wrenches are common and widely used tools in a wide variety of fields and mechanical undertakings, such as, for example, automotive manufacturing and repair, home repair, electronics manufacturing, etc. A typically socket wrench comprises a handle or bar connected to a removable socket sized to fit a nut or bolt. The socket fits a nut or bolt to loosen or tighten the nut or bolt as desired. The removable socket is usually one of a set of sockets for a particular wrench. Such a set of sockets may vary in drive depth, diameter, units of measurement and shape.

Each individual socket often includes a holding means, such as, for example, a drive nub, for retaining the socket to the wrench. The socket and wrench may also allow for ratcheting means, such as, a swiveling hinge or universal joint.

An exterior of most sockets is shaped as a circular cylinder. Typically, the holding means of the socket is towards a top side of the socket. A bottom side of the socket usually comprises an opening. The opening is a particular shape, depth, diameter, etc. to properly fit a nut or bolt such that the nut or bolt can be loosened or tightened as needed.

As one may imagine, there are a vast variety of different sockets possible when considering the possible drive sizes, shapes, diameters, etc. possible for a set of sockets. Further, one can become quickly frustrated when trying to quickly and efficiently determining a proper socket to be used for a particular job.

As such, it is desirable to have a means of storing and organizing various individual and sets of sockets so one may keep all the sockets in a single place, avoid losing sockets, have a way of transporting the sockets when desired, and keep the sockets readily available for use. Further, it would be desired to keep the sockets stored and organized to limit damage to the sockets or other tools.

Various means of storing sockets and wrenches have been proposed. In U.S. Pat. No. 4,353,465 to Rado, for example, a tray having a plurality of seats having retainers is show. Individual sockets are placed over the retainers whereby the retainer is slightly urged together to provide a spring force to grip the socket. However, the retainers can become less resilient over time, become lost, and add weight to the overall tray thereby making it less transportable. Further, size, diameter, shape, etc. of the associated sockets is not identified.

U.S. Pat. No. 5,154,544 to Arendt describes a organizing/storage device having a planar base with a plurality of round cylindrical posts projecting upward from the base. The posts are sized to accept different socket drives. However, the base is not easily transportable and the socket characteristics are not readily apparent to an individual searching for a particular drive size, shape or diameter socket.

U.S. Pat. Nos. 6,571,669 and 6,808,067, both to Benatz et al., describe a socket wrench organizer having a top socket holder and bottom socket holder, whereby the sockets are secured by a magnet. This socket wrench organizer is readily transportable, but does not readily allow for transporting a wide variety or significant number of varied sockets or sets of sockets. Further, the characteristics of the sockets are not identified.

Thus, what is desired is a transportable storage and organizing means for sockets, wherein several varied sets of sockets or other similar tool accessories can be organized and identified in a cost-effective way.

SUMMARY

The various exemplary embodiments of the present invention comprise a transportable container for organizing various hand tool attachments. The transportable container comprises at least one handle, raised periphery edges, one of more sets of cavities for individually storing and retaining hand tool attachments, and one or more labels. It is preferred that the hand tool attachments be arranged in an order based on incremental shape, size, drive size, or a combination thereof. The one or more labels identifying the shape, size, drive size, or a combination thereof of an individualized hand tool attachment position within the container.

BRIEF DESCRIPTION OF DRAWINGS

The various exemplary embodiments of the present invention, which will become more apparent as the description proceeds, are described in the following detailed description in conjunction with the accompanying drawings, in which.

DETAILED DESCRIPTION

Figure 1:
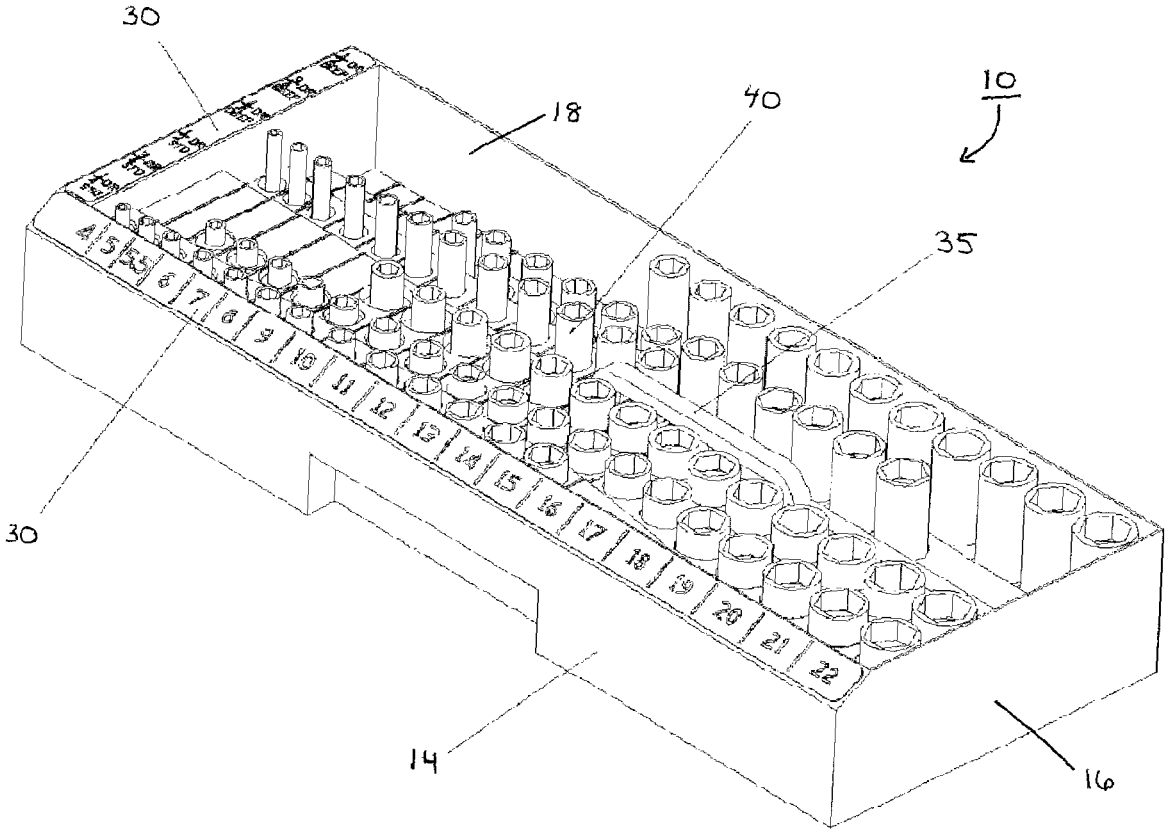
FIG. 1 is a perspective view of an exemplary embodiment of the present invention.
Figure 2:
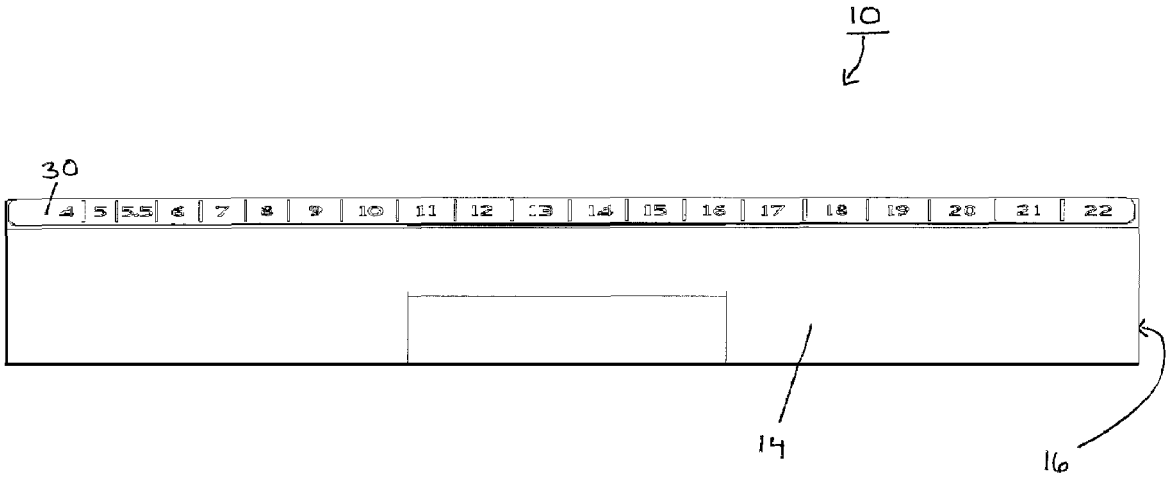
FIG. 2 is front view of an exemplary embodiment of the present invention.

An exemplary embodiment of the present invention is represented in FIGS. 1 and 2 in which a transportable container 10 comprises a base 12, front face 14, side walls 16, and a back wall 18. An upper portion of each of the front face, side walls, and back wall form periphery edges around the base.

Although the drawings show the transportable container as substantially rectangular, it should be noted that this is a preferable embodiment. However, the transportable carrier may be of any desired geometric shape.

The base of the transportable carrier may not be substantially flat. In a preferred embodiment, the base is a set of raised cavities 22 for retaining and organizing hand tool accessories, such as, for example, sockets 40.

In a preferred embodiment, the hand tool accessories are sockets.

The cavities are preferably slightly larger in shape and size than a corresponding exterior shape and size of a particular hand tool accessory. In other words, the inner walls 24 of the cavity are preferably slightly larger than the exterior of a particular hand tool accessory. As such, the hand tool accessory may fit snuggly into the corresponding cavities.

In the various exemplary embodiments in which the hand tool accessories are sockets, it is preferred that the cavities be cylindrical in shape.

Figure 5:
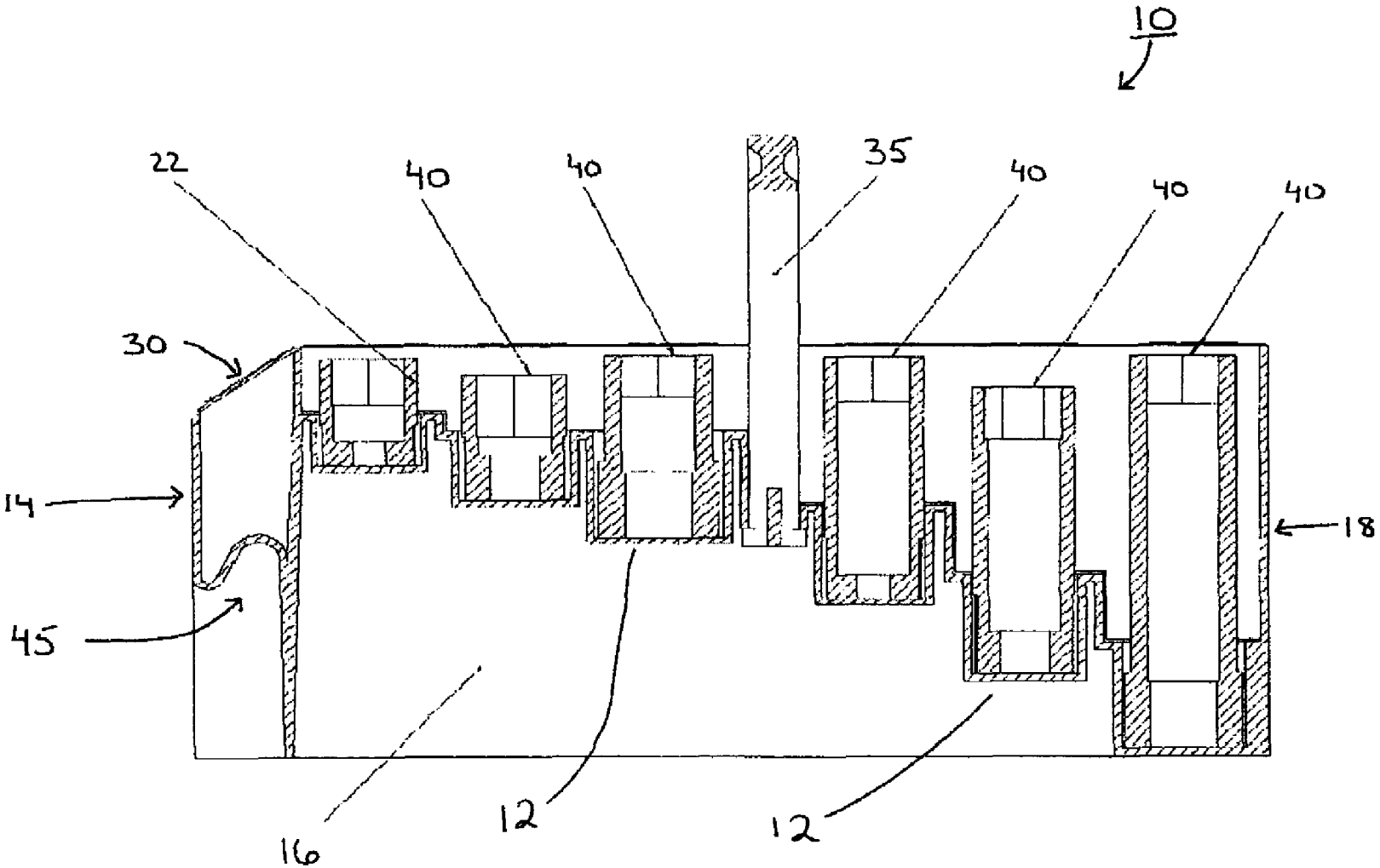
FIG. 5 is a side view of a cross-section of an exemplary embodiment of the present invention.
Figure 6:
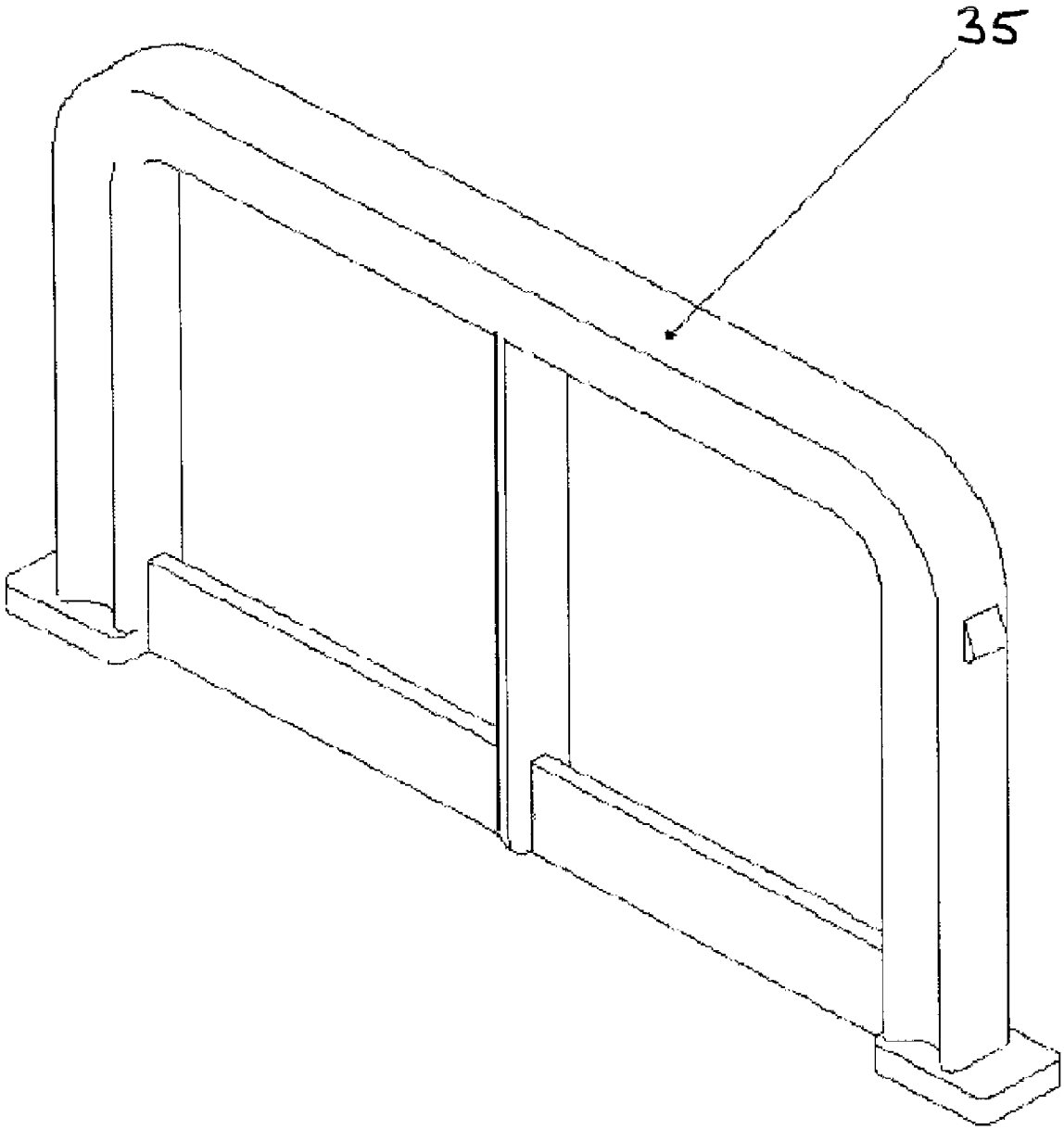
FIG. 6 is an illustration of a handle of an exemplary embodiment of the present invention.

Having the base not be substantially flat, and comprise a set of raised cavities is more readily evident in FIGS. 5 and 6. FIG. 5 is a perspective view of an exemplary embodiment of the present invention. As shown in FIG. 5, this embodiment has six rows 28 of cavities. The depth relative to the periphery edges of the transportable container of each row and each individual cavity may vary depending on a drive depth, shape, or size of a socket meant to be retained and stored in the respective cavity.

Figure 3:
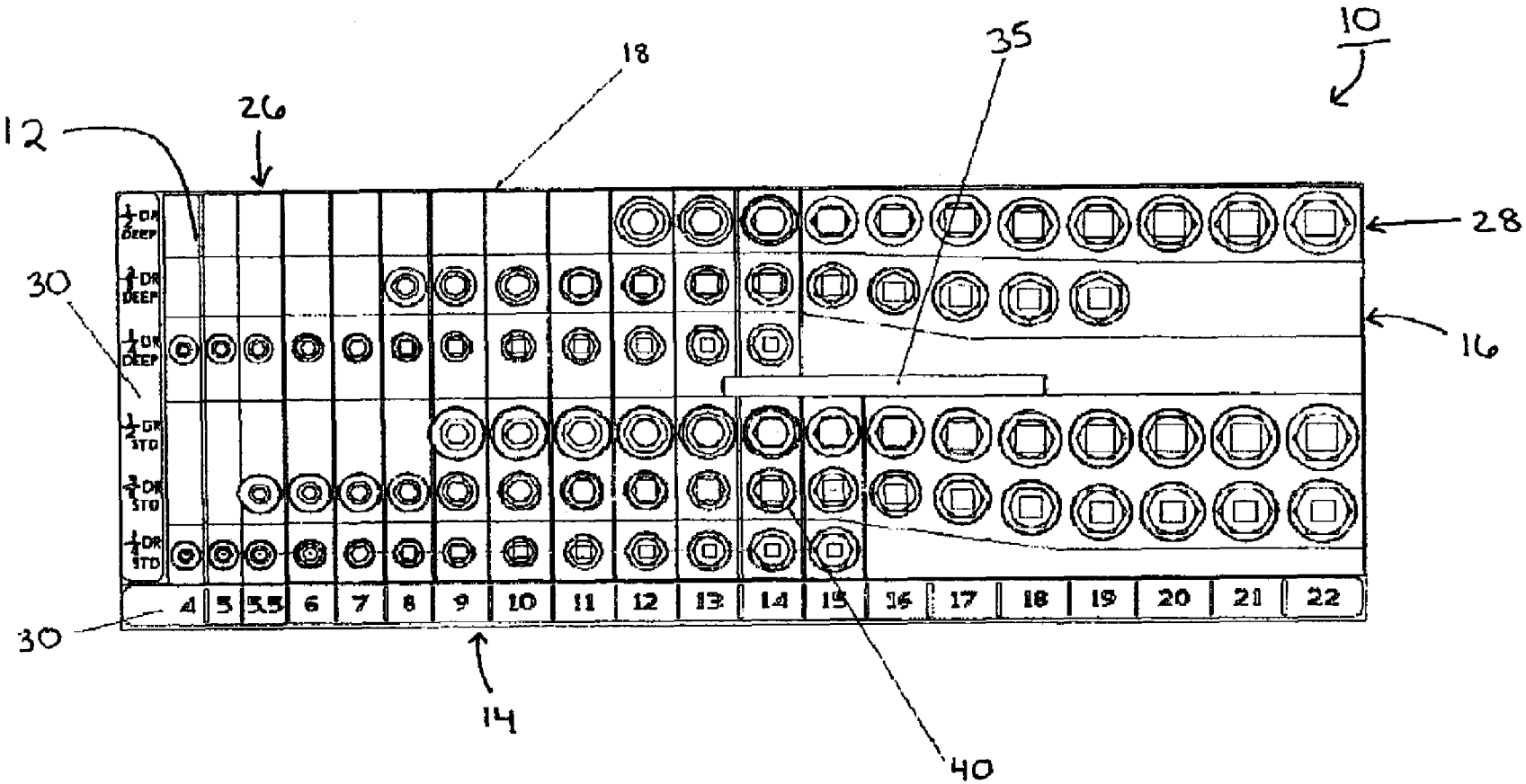
FIG. 3 is a top view of an exemplary embodiment of the present invention.
Figure 4:
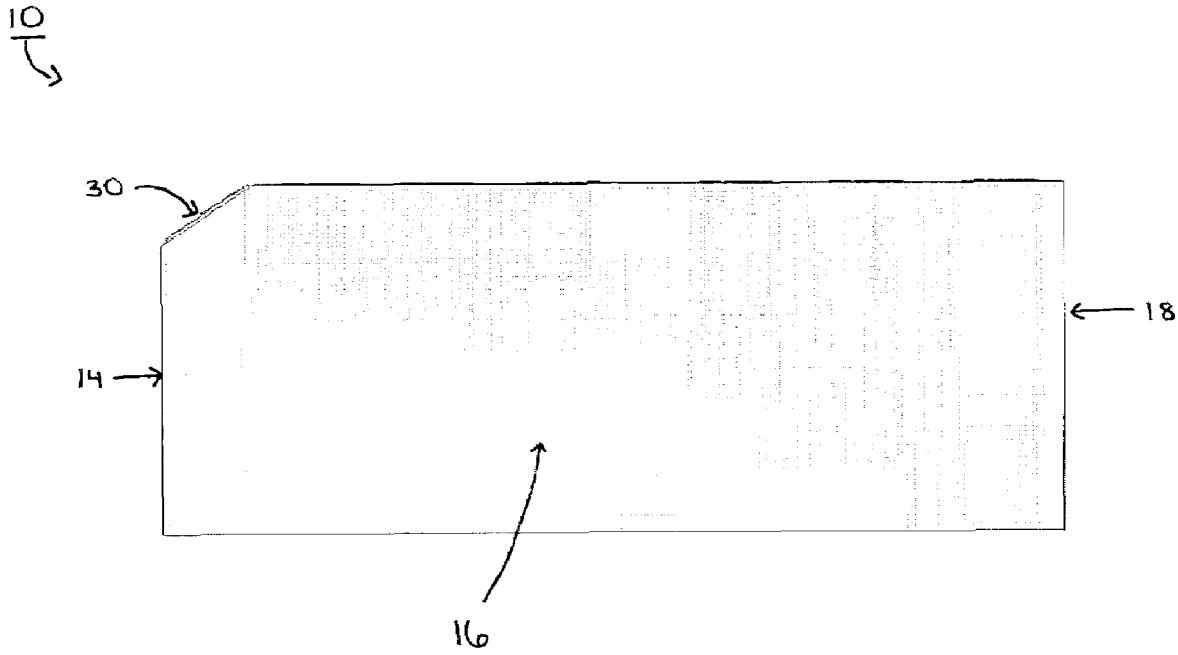
FIG. 4 is a view from one side of an exemplary embodiment of the present invention.

In a preferred embodiment, the cavities are arranged in a grid-like pattern of columns and rows. This is most evident in FIG. 3. In the exemplary embodiment shown in FIG. 3, there are six rows and twenty columns. In this example, the rows are arranged such that the sockets in the same row have the same drive depth and shape. However, as the sockets progress from left to right in a row, the size of the socket increases. This increase in size may be based on inches or metric measurements, but preferably, is based on standard and commercially available sizes of sockets.

As the size of the sockets increases from left to right in a row, it is preferred that the columns include one or more sockets of the same size. For example, in FIG. 3, there are two sockets in the first column on the left, meaning two sockets have the same first size. In the third column from the left, though, there are three sockets have the same size. In the tenth row, there are six sockets having the same size. Thus, it is preferred that the rows identify and organize sockets having the same size but otherwise having different shapes or drive depths.

In an exemplary embodiment, labels are placed on periphery edges of the transportable container to identify the rows, columns, or both.

Although the embodiment of the rows and columns herein is based on size and drive depth, it can also be based upon the actually shape of the corresponding socket. That is, the socket may shaped to fit three or more points of a nut, bolt or the like. For example, the socket may be shaped to fit a triangular shaped nut or bolt, a square shaped nut or bolt, a pentagon shapes nut or bolt, a hexagon shaped nut or bolt, etc.

The transportable container may be comprised of plastic, metal, ceramic, alloy, or a combination thereof. In a preferred embodiment, the transportable container is comprised of plastic.

In various exemplary embodiments, it is also preferred that the transportable container be a single piece of material. As a single piece of material, it is preferred if the transportable container be comprised of a molded plastic.

In various exemplary embodiments, the transportable container may comprise a lid 50. Such a lid may be attached via one or more hinges or by sliding the lid into a set of grooves (not shown) near the periphery edges.

The transportable container may further comprise a first handle. The first handle 35 is comprised of plastic, metal, ceramic, alloy, or a combination thereof, and is shown in FIG. 6. In a preferred embodiment, the first handle is comprised of plastic.

When present, the first handle is arranged such that it is located substantially near the center of the base of the transportable container. Thus, the first handle may be located between columns and rows of the cavities of the transportable container.

In the various exemplary embodiments, the first handle is retractable such that when not in use, that is, being gripped to carry the transportable container, the handle may withdraw or be pushed down toward the base of the transportable container in order that it does not get in the way of an individual removing a socket or placing a socket into the transportable container.

Figure 7:
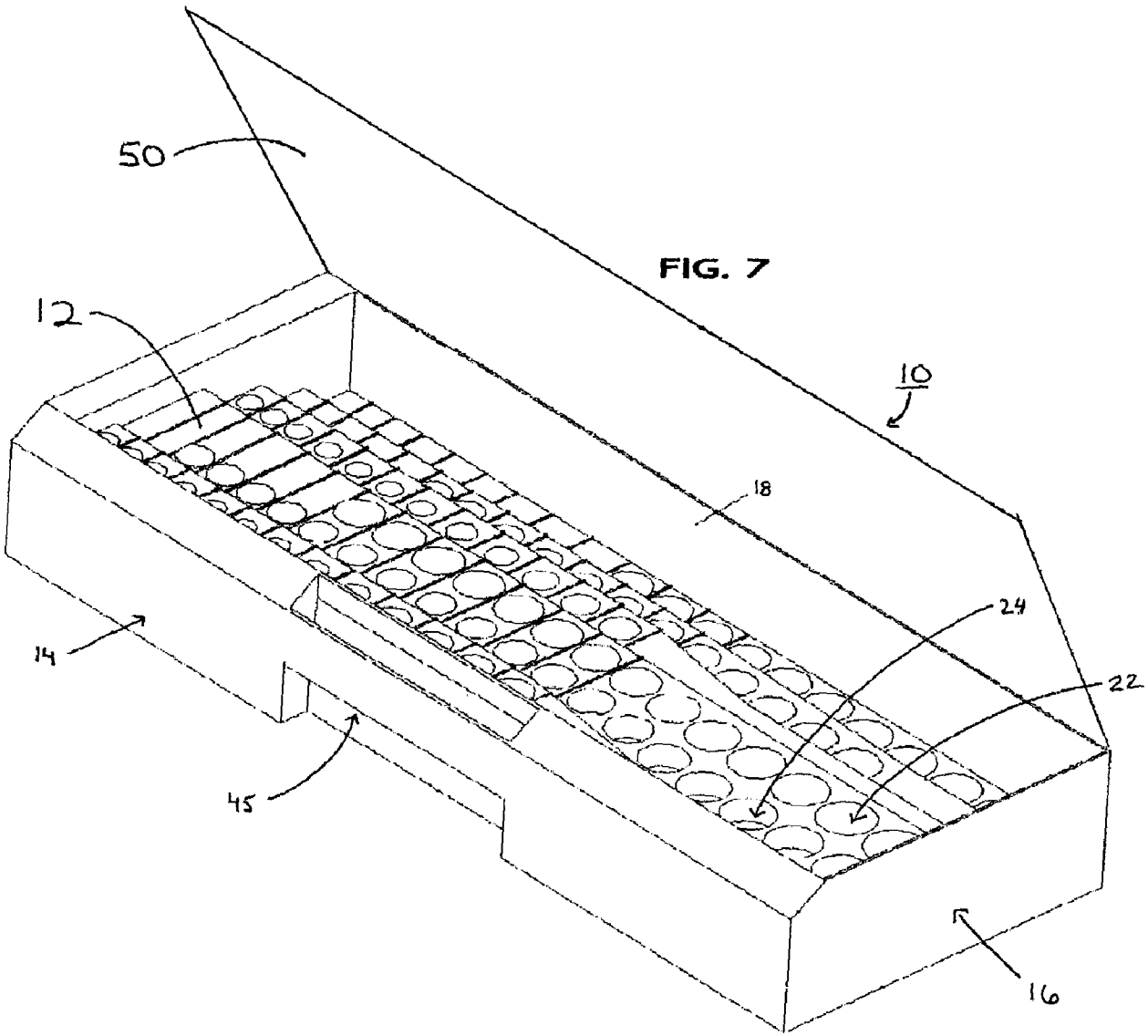
FIG. 7 is an illustration of an exemplary embodiment of the present invention not having any sockets.

The transportable container may comprise a second handle as shown in FIG. 7. The second handle may allow for pulling/sliding of the transportable container, or carrying the transportable container if the top of the container is covered with a lid to better ensure that the sockets retained and organized in the cavities do not fall out.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A transportable container for organizing various hand tool attachments, wherein the container comprises:

at least one handle;

raised periphery edges and a base;

one or more sets of cavities for individually storing and retaining hand tool attachments, wherein the one or more sets of cavities have inner walls connecting to the base such that a depth of the one or more sets of cavities relate to a size of the hand tool attachments, wherein the hand tool attachments are arranged in an order based on incremental shape, size, drive size, or a combination thereof; and one or more labels identifying the shape, size, drive size, or a combination thereof of an individualized hand tool attachment position within the container.

2. The container according to claim 1, wherein the container is comprised of plastic.

3. The container according to claim 1, wherein the container is comprised of a single piece of plastic.

4. The container according to claim 1, wherein the handle is retractable.

5. The container according to claim 1, wherein the handle is plastic.

6. The container according to claim 5, wherein the handle is substantially in a center portion of the container within the periphery edges.

7. The container according to claim 1, wherein the hand tool attachments are sockets for socket wrenches.

8. The container according to claim 1, wherein the cavities are cylindrical and incrementally larger in diameter.

9. The container according to claim 8, wherein the diameter increases by one sixteenth of an inch.

10. The container according to claim 8, wherein the diameter increases by metric units.

11. The container according to claim 1, wherein the one or more sets of cavities are positioned in a substantially linear and grid arrangement comprising columns and rows.

12. The container according to claim 11, wherein the rows correspond to a drive depth of the hand tool attachment.

13. The container according to claim 12, wherein the columns correspond to the size of the hand tool attachment.

14. The container according to claim 1, further comprising a second handle molded into the raised periphery edges of the transportable container.

15. The container according to claim 1, further comprising a lid.

* * * * *